US007526817B2

(12) United States Patent
Zuckerwar

(10) Patent No.: US 7,526,817 B2
(45) Date of Patent: May 5, 2009

(54) HAND-WEAR WITH VARIED INSULATION

(75) Inventor: Richard J. Zuckerwar, Gloversville, NY (US)

(73) Assignee: Grandoe Corporation, Gloversville, NY (US)

( * ) Notice: Subject to any disclaimer, the term of this patent is extended or adjusted under 35 U.S.C. 154(b) by 27 days.

(21) Appl. No.: 10/978,690

(22) Filed: Nov. 1, 2004

(65) Prior Publication Data

US 2006/0090242 A1 May 4, 2006

(51) Int. Cl.
*A41D 19/00* (2006.01)

(52) U.S. Cl. ..... 2/159; 2/164

(58) Field of Classification Search ..... 2/159, 2/164, 161.3, 161.8, 167, 16, 161.1
See application file for complete search history.

(56) References Cited

U.S. PATENT DOCUMENTS 4,583,248 A * 4/1986 Edwards et al. ..... 2/164
4,727,602 A * 3/1988 Giese et al. ..... 2/163
4,733,412 A * 3/1988 Campbell ..... 2/161.1
5,167,038 A * 12/1992 Rinehart ..... 2/164
5,537,692 A * 7/1996 Dorr ..... 2/161.1
5,740,551 A * 4/1998 Walker ..... 2/16
6,718,556 B2 4/2004 Zuckerwar et al.
2003/0074713 A1 * 4/2003 Zuckerwar et al. ..... 2/159
2006/0048268 A1 * 3/2006 Loos ..... 2/161.6

* cited by examiner

*Primary Examiner*—Gary L Welch
*Assistant Examiner*—Alissa J Tompkins
(74) *Attorney, Agent, or Firm*—Keith D. Nowak; Carter, Ledyard & Milburn LLP

(57) ABSTRACT

The present invention relates generally to an article of apparel in the form of a hand-worn article, such as a mitten or glove. The hand-worn article has an inner lining into which the wearer's hand is inserted, an insulating layer covering the inner lining, and an outer cover covering all of the above. The insulating layer has varied insulation to provide multiple levels of insulation to the wearer's hand. The hand-worn article so formed is capable of providing enhanced comfort to the wearer's hand. Moreover, the present invention also relates to an insulating item, such as for use to make a body-worn article. Furthermore, the present invention relates to a method of making a hand-worn article using the insulating layer to provide enhanced insulation and/or dexterity.

15 Claims, 3 Drawing Sheets

HAND-WEAR WITH VARIED INSULATION

FIELD OF THE INVENTION

The present invention relates generally to an article of apparel with enhanced comfort. In particular, the present invention relates to an article of clothing in the form of hand-wear (e.g., a mitten or glove) that has enhanced insulation for protection from the cold and/or enhanced dexterity. Moreover, the present invention relates to a method of making such an article of apparel.

BACKGROUND OF THE INVENTION

Cold weather greatly increases the rate at which our bodies lose heat to their surroundings. It is a well-known fact that when you get cold your body's extremities lose heat and circulation first. Our bodies conserve the temperature at the center by reducing the blood flow to the arms and legs. In effect, the critical central temperature of our torsos, which contain all of our vital organs, is maintained at the expense of the extremities.

Therefore, it is vital to keep the extremities of a wearer warm in order to avoid a drop in body temperature in cold weather (for our purposes, only hand-wear covering the fingers will be discussed). Hand-wear, in the form of gloves and mittens, have long been the choice of wear in cold weather. Although different portions of a hand do not need the same level of insulation in all areas, traditional winter hand-wear utilizes a uniform density insulation lining to keep the users' hands warm. Consequently, traditional hand-wear tends to be more bulky, less dexterous, which can cause fatigue to the user's hand. Moreover, certain portions of a hand can be overheated.

Notwithstanding the advances in the fabrics and insulating liners used in their manufacture, the increase in the cold insulation properties have generally come at the expense of loss of tactile sensation through the garment and/or increased overall bulkiness and loss of comfort for the wearer. It is an on-going struggle to balance the hand-wear's warmth-retaining qualities with the loss of dexterity because of increased insulation. There is generally a compromise between the desire to maintain warmth in cold weather conditions, and the desire to provide as much tactile sensation as possible through the hand-wear.

Accordingly, there continues to exist a need to provide for superior cold weather comfort (warmth), while at the same time preserving the integrity of the cold weather hand-wear and maximizing dexterity through such hand-wear. The present invention provides such an article of apparel including hand-wear.

SUMMARY OF THE INVENTION

The present invention provides an article of apparel with enhanced comfort. In particular, the present invention provides a hand-worn article having enhanced insulation for protection from the cold and/or enhanced dexterity. For example, the hand-worn article can comprise an inner lining into which the wearer's hand is inserted, an insulating layer covering the inner lining, and an outer cover covering all of the above. According to one aspect of the present invention, the insulating layer can have varied insulation to afford multiple levels of insulation. For example, the varied insulation can be achieved by altering the density, thickness, and/or the insulating material of the insulating layer, such as depending on different insulation need of the wearer's hand portions.

The hand-worn article so formed can afford enhanced insulation and/or enhanced dexterity to the wearer's hand.

According to another aspect of the present invention, the hand-worn article can be formed with one or more flexing zones to provide enhanced dexterity to the wearer's hand. The dexterity can be achieved by providing one or more flexing zones on the hand-worn article for covering one or more flexing joint portions of the wearer's hand. For example, the flexing zones can be formed by an elasticized or stretchable material to allow the wearer's hand to bend or flex more easily. The flexing zones can enhance dexterity of the hand-worn article without exposure of the hand or fingers to the ambient environment.

The present invention also relates to a method of making a hand-worn article. The method can comprise identifying a plurality of portions of the wearer's hand that release greater and lesser degrees of heat than the rest of the wearer's hand. Additionally or alternatively, the method can comprise identifying a plurality of hand portions that have different flexing degrees. An insulating layer can be prepared to provide varied insulation and/or dexterity to the respective hand portions of the wearer. A hand-worn article can be formed using such an insulating layer to provide enhanced insulation and/or enhanced dexterity to the wearer's hand.

BRIEF DESCRIPTION OF THE DRAWINGS

The detailed description of the present invention will be better understood in conjunction with the accompanying drawings, in which.

DETAILED DESCRIPTION OF THE INVENTION

Figure 2:
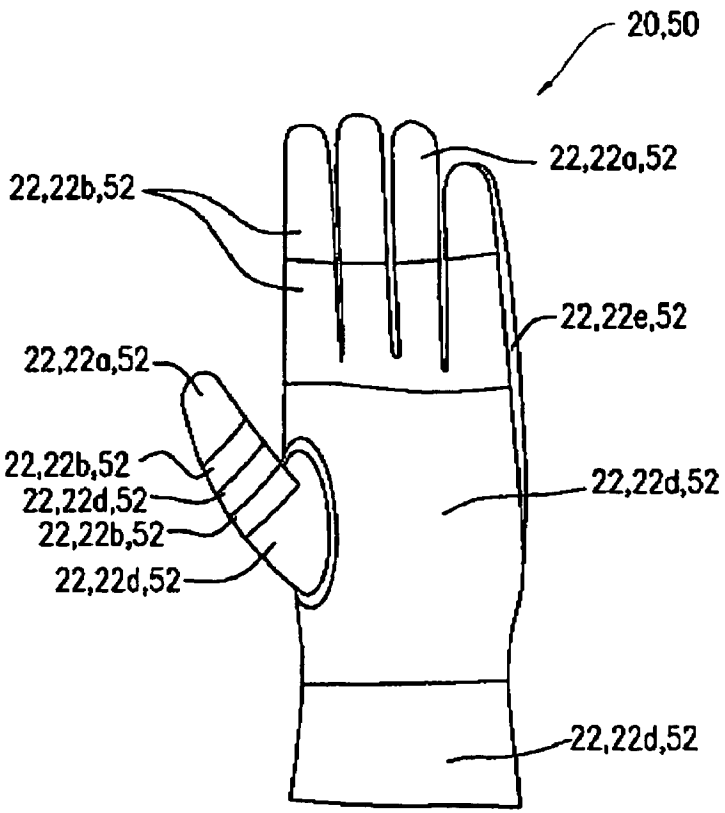
FIG. 2 shows a second exemplary embodiment of an insulating layer.

Exemplary articles of apparel in the form of hand-wear are illustrated throughout the drawings. In the following description of various exemplary embodiments of hand-wear, similar elements or components thereof are designated with same reference numbers or characters and redundant description is omitted. It should be understood that the exemplary hand-wear shown in the drawings are not to be considered limiting in any manner and that various features from the different embodiments are to be considered.

The present invention can provide an article of apparel 1 which can afford enhanced comfort, such as enhanced insulation and/or enhanced dexterity, to the user. The article of apparel 1 can be used to cover at least a portion of a user's body and provide an insulation effect to such a body portion.

Figure 3:
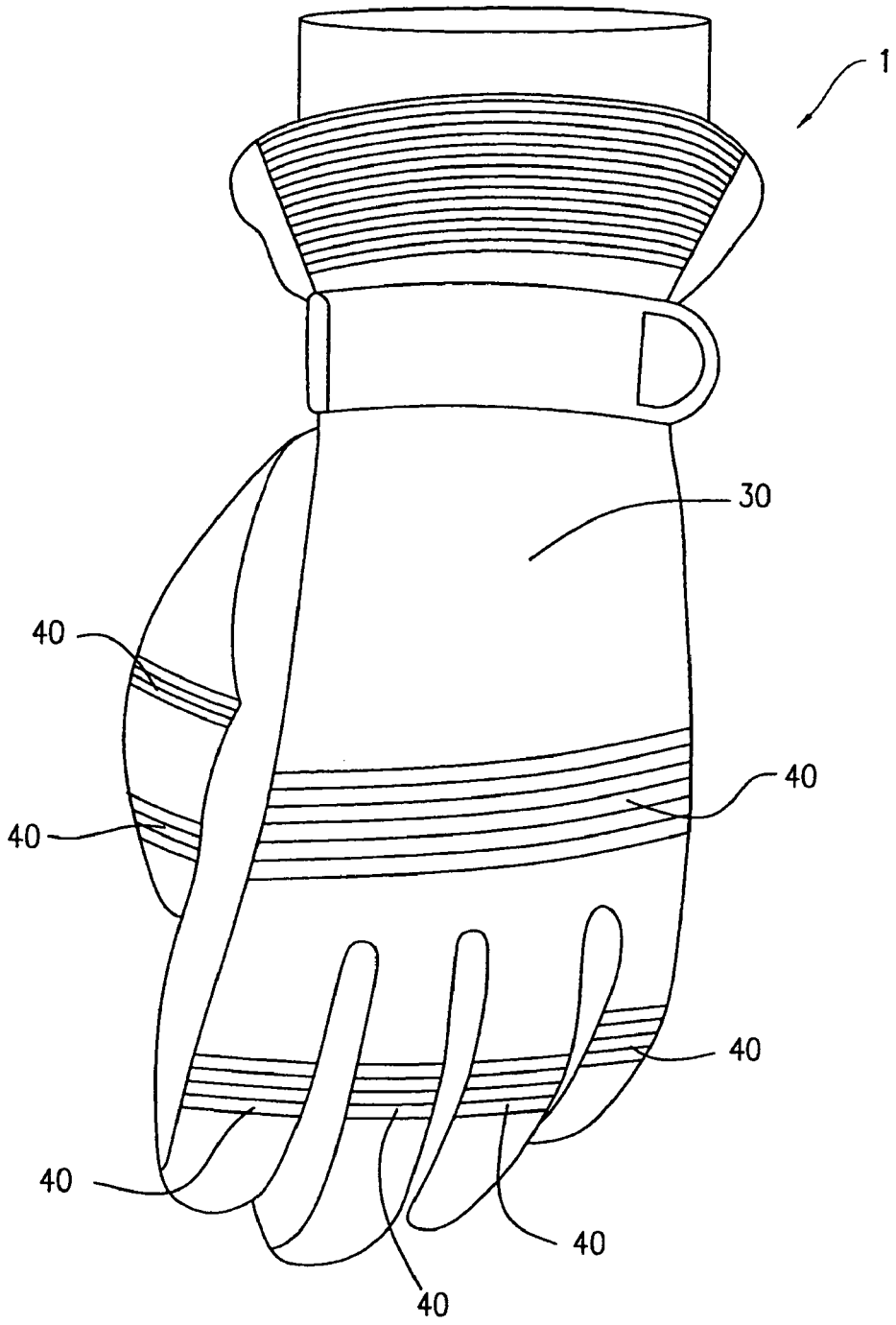
FIG. 3 shows an exemplary outer cover of an article of apparel.

In one embodiment, such as shown in FIG. 3, the article of apparel 1 can be in the form of a hand-worn article, such as glove or mitten. In an exemplary embodiment, the hand-worn article 1 can comprise an inner lining 10 into which the wearer's hand is inserted, an insulating layer 20 covering the inner lining 10, and an outer cover 30 covering all of the above. If desired, additional accessories or decorative elements can be provided to the hand-worn article 1. In one exemplary embodiment, the inner lining 10 can be made of a moisture-absorbent or similar material that feels comfortable to the wearer's hand. The insulating layer 20 can comprise an insulating material for protecting the wearer's hand and will be described in great detail below. In another exemplary embodiment, the outer cover 30 can comprise a water resistant material. One skilled in the art will appreciate that the hand-worn article 1 can be formed in various shapes (e.g., glove or mitten) and for various purposes such as sports gloves (e.g., ski gloves), which are all within the scope of the present invention.

According to one aspect of the present invention, the article of apparel 1 can be formed in various manners to provide varied insulation. In an exemplary embodiment, the insulating layer 20 can be formed in various manners to provide multiple levels of insulation. For example, the multiple levels of insulation can be determined based on the insulation need of different portions of the wearer's hand. In one exemplary embodiment, the portion of insulating layer 20 covering the tip portions of the wearer's hand can be formed to provide more insulation than that surrounding the rest of the digital portions. In another exemplary embodiment, the portion of insulating layer 20 covering the palm portion of the wearer's hand can be formed with a less insulation effect than that covering the back of the wearer's hand. One skilled in the art will appreciate that the article of apparel or hand-worn article 1 can be formed in various other manners to provide varied insulation, which are all within the scope of the present invention.

The insulation effect of the insulating layer 20 can vary in various ways. In one exemplary embodiment, the insulating layer 20 can be formed to provide a gradually changing insulation effect to the wearer. In another exemplary embodiment, the insulating layer 20 can comprise a plurality of sections 22 which are capable of affording different levels of insulation to different body portions of the wearer that need different levels of insulation. The insulation effect of each section 22 can be determined based on various factors, such as heat loss rate of the corresponding hand portion. For example, the insulating layer 22 can comprise a plurality of sections 22, such as sections 22*a*, 22*b*, 22*c*, and 22*d* for covering finger tip portions, joint portions, back portion, and/or the remaining hand portions, respectively. One skilled in the art will appreciate that the insulation effect of the insulating layer 20 can be designed to vary in various other manners, which are all within the scope of the present invention.

Additionally or alternatively, the insulating layer 20 can be formed in various manners to provide varied insulation. In one exemplary embodiment, the insulating layer 20 can be formed to have varied density. For example, the sections 22 of the insulating layer 20 can be formed with an insulating material having different densities. In another exemplary embodiment, one or more sections 22*a* covering the tip portions of the wearer's hand can be formed with an insulating material with a higher density to provide more insulation to such hand portions.

In another exemplary embodiment, the insulating layer 20 can be formed to have varied thickness. For example, the plural sections 22 can have different thicknesses for covering different body portions of the wearer that need different level of insulation. When a section 22 is formed with a larger thickness, such a section 22 is typically capable of affording additional insulation comparing to a section 22 having a less thickness.

In a further exemplary embodiment, the plurality of sections 22 can be made of different insulating materials that have different insulation effects. For example, a section 22 made of micro-fibers or fleece can provide more insulation than that made of conventional cotton material. In one exemplary embodiment, the insulating layer 20 covering the back of the wearer's hand can be formed with micro-fibers or fleece material. One skilled in the art will appreciate that the insulating layer 20 and sections 22 can be formed in various other manners to provide varied insulation, which are also within the scope of the present invention.

According to another aspect of the present invention, the article of apparel 1 can be formed to provide enhanced dexterity to the wearer. For example, the article of apparel 1 can comprise one or more of flexing zones 40 to allow the wearer to move a body portion more easily and hence to reduce fatigue. In one exemplary embodiment, the flexing zones 40 can be formed on the insulating layer 20 as one or more sections 22 having a lesser density and/or thickness than other sections 22. For example, the insulating layer 20 of a hand-worn article 1 can comprise one or more sections 22*b* formed with a lesser density and/or thickness to allow one or more joint portions of the wearer's hand to bend or flex more easily.

Additionally or alternatively, one or more flexing zones 40 can comprise an elasticized or stretchable material, which is capable of providing and/or enhancing dexterity. For example, the flexing zones 40 can comprise an elasticized material to allow the wearer's hand to grip with ease. In one exemplary embodiment, the entire hand-worn article 1 can comprise a stretchable material. In another exemplary embodiment, one or more flexing zones 40 can be formed to cover one or more joint portions of the wearer's hand to allow the joint portions to bend or flex more easily.

The flexing zones 40 can be formed on one or more of the inner lining 10, the insulating layer 20, and the outer cover 30 of the hand-worn article 1. In one exemplary embodiment, one or more flexing zones 40 can be formed on the insulating layer 20 covering one or more joint portions of the wearer's hand. In another exemplary embodiment, one or more flexing zones 40 can be formed on the outer cover 30 covering one or more joint portions of the wearer's hand. In a further exemplary embodiment, one or more flexing zones 40 formed on the insulating layer 20 can overlap with those formed on the outer cover 30. One skilled in the art will appreciate that the flexing zones 40 can be formed in various other manners to enhance dexterity, without exposure of the wearer's body portion to the ambient environment, which are also within the scope of the present invention.

The present invention can also provide an insulating item 50, which can afford enhanced comfort to the user. The insulating item 50 can be formed in various manners that are similar to those of the insulating layer 20 described above. For example, the insulating item 50 can comprise multiple sections 52 with multiple levels of insulation. The multiple sections 52 of the insulating item 50 can be formed in various manners to afford enhanced comfort to the wearer. In one exemplary embodiment, one or more sections 52 covering the user's non-flexing body portions can have a greater degree of insulation. In another exemplary embodiment, one or more sections 52 covering the user's flexing body portions can have a lesser degree of insulation.

Additionally or alternatively, the insulating item 50 can comprise an elasticized or stretchable material to enhance dexterity of the insulating item 50. In an exemplary embodiment, the entire insulating item 50 can be formed to be stretchable to allow the insulating item 50 to expand after being subject to tension. In another exemplary embodiment, the stretched insulating item 50 is capable of returning to its original shape once the tension is removed. One skilled in the art will appreciate that the insulating item 50 can be formed in various other manners to provide enhanced comfort to the user, which are also within the scope of the present invention.

The insulating item 50 can be used in various manners. In an exemplary embodiment, the insulating item 50 can be used to form a body covering article, such as a bedding article, such as a blanket, sheet, comforter, quilt, or other types of body covering items. In another exemplary embodiment, the insulating item 50 can be used to form an article of apparel 1. For example, the insulating item 50 can be formed to conform to at least a portion of the wearer's body. In an exemplary embodiment, the insulating 50 can be formed to conform to a body torso for use to make a vest. In another exemplary embodiment, such as shown in FIGS. 1A, 1B and 2, the insulating item 50 can be used as the insulating layer 20 of a hand-worn article 1, such as a mitten or glove.

Additionally or alternatively, the insulating item 50 can be used either alone or together with a lining and/or cover for additional protection. One skilled in the art will appreciate that the insulating item 50 can be used in various other manners or for various other purposes, which are also within the scope of the present invention.

The present invention will now be described in conjunction with the various accompanying drawings, which illustrate an exemplary article of apparel 1 in the form of a hand-wear (e.g., glove or mitten).

Figure 1A:
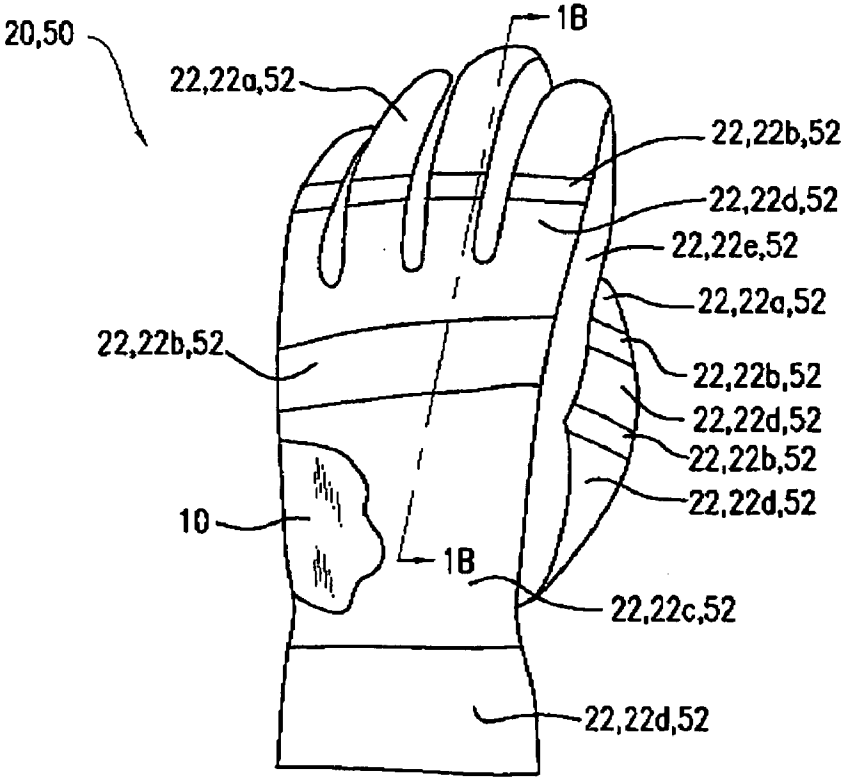
FIG. 1A shows an exemplary insulating layer of an article of apparel.
Figure 1B:
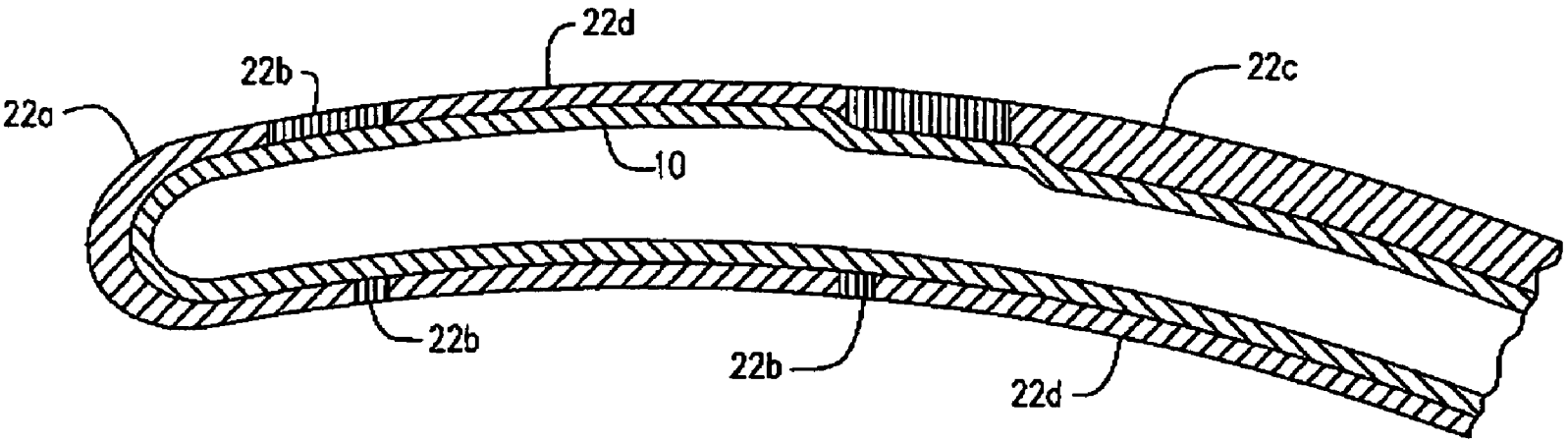
FIG. 1B is a sectional view of the article of apparel of FIG. 1A taken along line 1B-1B in FIG. 1A.

FIGS. 1A, 1B and 2 illustrate an insulating layer 20 for use as or in a hand-worn article 1. For example, the insulating layer 20 an be placed between the inner lining 10 and outer cover 30 to provide an insulation effect. The insulating layer 20 can be formed in various manners to afford enhanced comfort, such as enhanced insulation and/or enhanced dexterity, to various portions of the wearer's hand. For example, the insulating layer 20 can be formed to provide varied insulation to different portions of the wearer's hand to afford enhanced insulation. Additionally or alternatively, the insulating layer 20 can comprise an elasticized or stretchable material to enhance dexterity. In one exemplary embodiment, the insulating layer 20 can be partially or entirely stretchable during use to afford enhanced dexterity to the wearer's hand and reduce fatigue.

In an exemplary embodiment, such as shown in FIGS. 1A and 1B, the insulating layer 20 can comprise a plurality of sections 22 formed in various manners to provide enhanced comfort to the wearer's hand. For example, the plural sections 22 can have different insulation and/or dexterity effect. In one exemplary embodiment, one or more first sections 22*a* can be formed on the insulating layer 20 for covering one or more tip portions of the wearer's hand. In an exemplary embodiment, each first section 22*a* can be formed to extend from the digit tip toward the first digit joint. In another exemplary embodiment, each first section 22*a* can extend from the digit tip toward the second digit joint, such as shown in FIGS. 1A and 1B.

The first sections 22*a* can be formed to provide a greater level of insulation to the tip portions of the wearer's hand. For example, the first sections 22*a* can be formed with a denser or thicker insulation material than that covering the remaining digital portions of the hand. One skilled in the art will appreciate that the first sections 22*a* can be formed in various other manners, which are also within the scope of the present invention.

In another exemplary embodiment, one or more second sections 22*b* can be formed on the insulating layer 20 for covering one or more of the joint portions of the wearer's hand, such as the first digit joints, the second digit joints, and the knuckles. In an exemplary embodiment, a second section 22*b* can be formed to cover each of the second digit joints and knuckles. In another exemplary embodiment, a plurality of second sections 22*b* covering the knuckles can be merged, such as shown in FIG. 1A.

The second sections 22*b* can be formed for providing a lesser level of insulation to one or more joint portions of the wearer's hand. For example, the second sections 22*b* can have a reduced density and/or thickness. In one exemplary embodiment, the second sections 22*b* can have the least thickness to afford enhanced dexterity to the hard-worn article 1. In another exemplary embodiment, one or more of the second sections 22*b* can be formed to comprise an elasticized or stretchable material to enhance dexterity. One skilled in the art will appreciate that the second sections 22*b* can be formed in various other manners, which are also within the scope of the present invention.

In a further exemplary embodiment, one or more third sections 22*c* can be formed on the insulating layer 20 for providing the highest level of insulation. In an exemplary embodiment, a third section 22*c* can be formed to the back of the wearer's hand to afford maximum protection from the cold. One skilled in the art will appreciate that the third sections 22*c* can be formed in various other manners, which are also within the scope of the present invention.

In another exemplary embodiment, such as shown in FIG. 2, one or more fourth sections 22*d* can be formed on the insulating layer 20 affording a different level of insulation from that of any of the first, second, and third sections 22*a*, 22*b*, and 22*c*. For example, one or more fourth sections 22*d* can be provided to form the rest of the insulating layer 20 to cover the remaining portions of the wearer's hand in need of protection. In an exemplary embodiment, a fourth section 22*d* can be formed to cover the wearer's palm portion. In another exemplary embodiment, one or more fourth sections 22*d* can be formed to cover the remaining portions of the wearer's digits. One skilled in the art will appreciate that the fourth sections 22*d* can be formed in various other manners, which are also within the scope of the present invention.

In a further exemplary embodiment, one or more additional sections can be provided to protect a hand portion of the wearer. For example, one or more side sections 22*e* can be formed to cover the side portions of the wearer's hand. In one exemplary embodiment, the side sections 22*e* can have a similar level of insulation to one of the above mentioned sections 22*a* to 22*d*. In another exemplary embodiment, the side sections 22*e* can be formed to afford a different level of insulation from the sections 22*a* to 22*d*. One skilled in the art will appreciate that the additional sections 22*e* can be formed to cover various other hand portions of the wearer and provide a desired level of insulation, which are also within the scope of the present invention.

Additionally or alternatively, one or more of the insulation sections 22*a* to 22*e* can be formed to further provide varied insulation to meet the different insulation needs of the hand portion protected. In one exemplary embodiment, either the first or the second section 22*a* or 22*b* can be formed to have a lesser insulation on the palm side of the hard-worn article 1 to reduce insulation to the wearer's palm. In another exemplary embodiment, the fourth sections 22*d* can further provide varied insulation to meet the different insulation needs of the remaining portions of the wearer's hand. For example, the fourth section 22*d* covering the wearer's palm can have a lesser insulation than those covering the remaining digital portions. One skilled in the art will appreciate that the various sections 22 can be formed in various other manners to further afford varied insulation, which are also within the scope of the present invention.

The insulating layer 20 described above can be assembled with an inner lining 10 and/or an outer cover 30 to form the hand-worn article 1 to provide enhanced comfort to the wearer's hand. In an exemplary embodiment, the insulating layer 20 can be placed on top of the inner lining 10 before being inserted into the outer cover 30. In another exemplary embodiment, the insulating layer 20 can be integrated with the inner lining 10. One skilled in the art will appreciate that the hand-worn article 1 can be formed in various other manners to afford enhanced comfort, which are also within the scope of the present invention.

Although the above description of the present invention is made in connection with an exemplary article of apparel in the form of hand-wear, one skilled in the art will appreciate that the present invention is applicable to various other apparels including, but not limited to, various types of clothing, such as body-worn articles (e.g., vests, sweaters, jackets, pants, or coats), foot-worn articles (e.g., insulating socks), head-worn articles (e.g., caps), and the like. Additionally or alternatively, the present invention is applicable to various body covering articles, such as sheets, blankets, comforters, quilts, sleeping bags, and the like.

It will be appreciated that the various features described herein may be used singly or in any combination thereof. Therefore, the present invention is not limited to only the embodiments specifically described herein. While the foregoing description and drawings represent a preferred embodiment of the present invention, it will be understood that various additions, modifications, and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiment is therefore to be considered in all respects as illustrative and not restrictive, the scope of the invention being indicated by the appended claims, and not limited to the foregoing description.

What is claimed is:

1. A method of making a hand-worn article, comprising:

identifying one or more first portions of the wearer's hand that release greater degrees of heat than the rest of the wearer's hand;

identifying one or more second portions of the wearer's hand that release lesser degrees of heat than the rest of the wearer's hand;

forming an insulating layer with multiple sections for providing multiple levels of insulation to the respective first and second hand portions;

wherein the insulating layer comprises one or more first sections for covering one or more first portions of the wearer's hand and one or more second sections for covering one or more second portions of the wearer's hand, said one or more second portions being one or more joint portions wherein one or more joint portions comprise each second digit joint, and wherein the second sections have a lesser thickness and a lesser insulation than the one or more first sections, said one or more first sections comprises one or more tip covering sections for covering fingertips of a wearer's hand, a back section for covering a back portion of a wearer's hand, one or more remaining sections for covering remaining portions of a wearer's hand, a palm section for covering a palm portion of a wearer's hand and one or more side sections for covering a side portions of a wearer's hand, each said one or more first sections being formed of insulating material, wherein said one or more tip covering sections being formed of thicker insulating material than the insulating material used at said one or more remaining sections;

wherein said insulating material of said back section is thicker than the insulating material of said one or more tip sections, said one or more remaining sections, said palm section and said one or more side sections;

wherein flexing zones are formed on only said one or more second sections of said insulating layer, said flexing zones comprises elasticized or stretchable material, said flexing zones being disposed between and connecting two of said one or more remaining sections; and forming the hand-worn article using the above insulating layer to provide varied insulation to the wearer's hand.

2. The method of claim 1, wherein said one or more joint portions of the wearer's hand further comprise knuckle joints wherein said one or more second sections covering said knuckle joints being disposed between and connecting said one or more remaining sections and said back section.

3. A hand-worn article, comprising;

an inner lining into which the wearer's hand is inserted;

an insulating layer covering the inner lining, the insulating layer having varied insulation to provide multiple levels of insulation, the insulating layer comprises one or more flexing zones covering only one or more joint portions of the wearer's hand, said one or more joint portions being each second digit joint, the insulating layer further comprises one or more tip covering sections covering one or more portions of the wearer's hand, said one or more tip covering sections being formed of insulating material, a back section covering a back of the wearer's hand, said back section being formed of insulating material, one or more remaining sections covering one or more remaining portions and a palm portion of a wearer's hand, said one or more remaining sections being formed of insulating material; and an outer covering all of the above, the outer cover comprises one or more flexing zones covering only one or more joint portions of the wearer's hand, said one or more joint portions being each second digit joint, wherein said flexing zones of said insulating layer overlap with said flexing zones of said outer cover;

wherein one of more of the flexing zones comprise an elasticized or stretchable material;

wherein said insulating material used at said back section is thicker than said insulating material used with said one or more tip covering sections and said remaining sections;

wherein said insulating material used at said one or more tip covering sections is thicker than said insulating material used with said one or more remaining sections;

wherein said flexing zones of said insulating layer being disposed between and connecting said one or more tip covering sections and said one or more remaining sections covering said remaining portions of said wearer's hand;

wherein the hand worn-article affords enhanced comfort to the wearer's hand.

4. The hand-worn article of claim 3, wherein said insulating layer further comprises one or more flexing zones covering knuckle joints, wherein said flexing zones are disposed between and connect said one or more remaining sections covering said one or more remaining portions of said wearer's hand with said back section covering said back portion of said wearer's hand.

5. The hand-worn article of claim 4, wherein said outer cover further comprises one or more flexing zones covering knuckle joints, wherein said flexing zones of said insulating layer overlap with said flexing zones of said outer cover.

6. A hand-worn article, comprising:

an inner lining into which the wearer's hand is inserted;

an insulating layer covering the inner lining, the insulating layer having varied insulation to provide multiple levels of insulation; and an outer cover covering all of the above, the outer cover comprises one or more flexing zones covering only one or more joint portions of the wearer's hand, said one or more joint portions being each second digit joint and knuckle joints;

wherein the insulating layer comprises one or more separate sections including one or more tip covering sections being formed of insulating material, one or more flexing zone sections being formed of an elasticized or stretchable material, a back section being formed of insulating material, one or more remaining sections being formed of insulating material, a palm section being formed of insulating material and one or more side sections being formed of insulating material;

wherein said one or more tip portions being formed of thicker insulating material than the insulating material used at said one or more remaining sections:

wherein said insulating material used at said back section has thicker insulating material than that used at said one or more tip covering sections, said one or more remaining sections, said palm section and said one or more side sections, wherein said one or more flexing zone sections covers only each second digit joint and knuckle joints, said one or more flexing zone sections covering said knuckle joints being disposed between and connecting said one or more remaining sections with said back section:

wherein one or more of the flexing zones comprise an elasticized or stretchable material;

wherein the hand-worn article affords enhanced comfort to the wearer's hand.

7. A hand-worn article, comprising:

an inner lining into which the wearer's hand is inserted; and an insulating layer covering the inner lining, said insulating layer having a plurality of separate sections, each separate section having a predetermined amount of insulating material contained therein, with the predetermined amount being varied to meet different insulating needs of different portions of the wearer's hand; said insulating layer comprising one or more flexing zones, said flexing zones comprising elasticized or stretchable material, said flexing zone covering only each second digit joint of the wearer's hand, said insulating layer further comprising one or more tip covering sections covering fingertip portions, a back section covering a back portion, one or more remaining sections covering remaining digital portions, a palm section covering a palm portion and one or more side sections covering side portions, said tip covering sections, said back sections, said remaining sections, said palm section and said side sections all being formed of insulating material;

wherein said one or more tip covering sections being formed of thicker insulating material than the insulating material used at said one or more remaining sections;

wherein said insulating material of said back section is thicker than the insulating material of said one or more tip sections, said one or more remaining sections, said palm section and said one or more side sections;

wherein said one or more flexing zones comprising said elasticized or stretchable material being disposed between and connecting two of said one or more remaining sections;

wherein the hand-worn article affords enhanced comfort and flexibility for the wearer.

8. The hand-worn article of claim 7, wherein the insulating layer provides different levels of insulation to each digit in the wearer's hand.

9. The hand-worn article of claim 8, wherein the insulating layer is formed of a plurality of sections made of different insulating materials.

10. The hand-worn article of claim 7, wherein the tip covering sections covering one or more of tip portions of the wearer's hand provides a greater level of insulation to the tip portions than to the remaining digital portions of the wearer's hand.

11. The hand-worn article of claim 7, wherein the flexing zones of said insulating layer provide a lesser level of insulation to each the second digit joint than to the remaining digital portions of the wearer's hand.

12. The hand-worn article of claim 7, wherein the insulating layer has varied densities.

13. The hand-worn article of claim 7, wherein the insulating layer has varied thicknesses.

14. The hand-worn article of claim 7 being a ski glove.

15. The hand-worn article of claim 7, wherein the said flexing zones further cover knuckle joints, wherein flexing zones covering said knuckle joints being disposed between and connecting said one or more remaining sections with said back section.

* * * * *